US007993220B2

(12) United States Patent
Enday

(10) Patent No.: US 7,993,220 B2
(45) Date of Patent: Aug. 9, 2011

(54) EXERCISE RACQUET

(76) Inventor: Baheta Enday, Torrensvile-Adelaide (AU)

( * ) Notice: Subject to any disclaimer, the term of this patent is extended or adjusted under 35 U.S.C. 154(b) by 0 days.

(21) Appl. No.: 12/792,713

(22) Filed: Jun. 2, 2010

(65) Prior Publication Data

US 2010/0331125 A1 Dec. 30, 2010

(30) Foreign Application Priority Data

Jun. 30, 2009 (AU) ..... 2009903023

(51) Int. Cl.
*A63B 69/38* (2006.01)

(52) U.S. Cl. ..... 473/463; 473/459

(58) Field of Classification Search ..... 473/459, 473/461, 463, 464, 228, 437, 457, 553
See application file for complete search history.

(56) References Cited

U.S. PATENT DOCUMENTS

| | | | | | |
|---|---|---|---|---|---|
| 3,809,397 | A | | 5/1974 | Gruenewald | |
| 3,820,785 | A | * | 6/1974 | Occhipinti et al. | 473/463 |
| 4,063,730 | A | * | 12/1977 | Bates | 473/463 |
| 4,141,549 | A | * | 2/1979 | Hayes et al. | 473/463 |
| 4,143,873 | A | * | 3/1979 | Andreoli | 473/463 |
| 4,183,526 | A | | 1/1980 | Brown | |
| 4,249,729 | A | * | 2/1981 | Gabrielidis | 473/464 |
| 4,671,510 | A | | 6/1987 | Schoenwetter | |
| 5,335,918 | A | * | 8/1994 | Rupnik et al. | 473/228 |
| 5,409,217 | A | * | 4/1995 | Bobby | 473/425 |
| 5,415,406 | A | * | 5/1995 | Reichenbach et al. | 473/228 |
| 5,501,451 | A | * | 3/1996 | Slusarczyk | 473/459 |
| 5,571,048 | A | * | 11/1996 | Kenney | 473/228 |
| 5,593,155 | A | * | 1/1997 | Fauble et al. | 473/463 |
| 5,755,633 | A | | 5/1998 | Marquez | |
| 6,238,299 | B1 | * | 5/2001 | Barnette | 473/228 |
| 6,866,592 | B1 | * | 3/2005 | Gitre | 473/228 |
| 2003/0207719 | A1 | | 11/2003 | Hughes | |
| 2006/0116257 | A1 | | 6/2006 | Shifferaw | |
| 2010/0331125 | A1 | * | 12/2010 | Enday | 473/463 |

FOREIGN PATENT DOCUMENTS

| | | | | |
|---|---|---|---|---|
| JP | 2004329350 | A | * | 11/2004 |
| WO | WO 9407577 | A1 | * | 4/1994 |
| WO | WO 9938581 | A1 | * | 8/1999 |

* cited by examiner

*Primary Examiner* — Raleigh W. Chiu
(74) *Attorney, Agent, or Firm* — Bio Intellectual Property Services (Bio IPS) LLC; O. M. (Sam) Zaghmout

(57) ABSTRACT

An exercise racquet to aid in the playing development of the user. The racquet incorporates a handle and a solid planar member extending from the handle. The planar member has a centrally located stabilizer member including a longitudinally concave length located on both surfaces of the planar member, the longitudinal concave length having curved wings with downwardly extending shoulders so that the planar member provides resistance to the racquet being stroked through the air and a stabilizer member to prevent the racquet from lifting.

7 Claims, 6 Drawing Sheets

EXERCISE RACQUET

CROSS-REFERENCE TO RELATED APPLICATIONS

This application claims the benefit of Australian Provisional Application No. 2009903023, filed Jun. 30, 2009. The entire disclosure of the prior application is hereby incorporated by reference.

FIELD OF THE INVENTION

This invention relates to an exercise racquet which is adapted to accelerate or improve the level of strength, endurance and control of a user and more particularly it relates to an improved exercise racquet that is adapted to offer rapid strength, endurance, control and development to a user without the long and repetitive training hours one would normally expect from stroking a racquet such as a tennis or a squash racquet.

BACKGROUND TO THE INVENTION

It is now recognised by those skilled in the art of sports development that if a player is to develop a suitable level to be considered an elite sportsperson, particularly those intent on playing competition tennis, there would be the requirement to train to in excess of 10,000 hours.

As is to be expected if one was to be involved in such repetitive training to the extent of 10,000 hours they would need to devote upwards of three hours per day, every single day for a period of 10 years so that a five year old by the time they reach fifteen years they arguably would have trained enough to develop the required power, control, stability and reflexes to appropriately manoeuvre the racquet to successfully achieve a winning style of play against other professionals also competing at the top echelon of their sport.

However as any good all rounded parent or even an unsophisticated child will point out, it is practically impossible to be able to train three hours plus a day for tennis day in day out from the age of 5 to now reach the required threshold of 10,000 hours in order to develop, as introduced above the necessary strength, power, control and stability so forth.

Not only is there the practicality that young children do not have three hours plus a day to train, in that they are required to undertake study, sleep and have some electronic social time, but in many instances weather conditions make it anything but conducive to have the opportunity of being out and about to complete the three hours of training plus per day.

Even if there is the opportunity of playing tennis indoors, which is very rare, there still is the requirement for one to leave ones home in inclement and cold weather which means that by the time they get to the indoor stadium a lot of time will be needed in warming up the body to get it in condition enough just to simply start training for tennis.

Hence under the current regime of the requirement to excessively train by way of long repetitive hours, it really should be for the most part to most parents unthinkable to have their young children involved in such a regime to reach a professional level in the sporting field of tennis.

As one would expect the problem then even becomes exacerbated when children that are around 10 or 11 old decide that they would like to become involved in tennis. It would then be practically beyond their realms of genetic possibility to get them trained up enough to have the necessary strength, endurance and control to again reach the elite level of professional tennis.

It is known that sports including tennis playing involve 60% physical and 40% mental effort. It is also known that to practice the same thing for long hours doesn't make one excellent but to train repeatedly for many years beyond the level of expectation and outside your capacity transforms one from ordinary to extraordinary.

Therefore, there is a recognized need to have a training device so that one could train exceeding more than ones limitation and expectation.

As a result, the training device should boost imprinting players muscle memory. The device should also facilitate the development of high complex physical movement in a relatively short period of time. The training device should elevate the ability of better anticipation power of the player by combining the motor complexity with the perpetual complexity (efficient anticipation).

What kind of training device is needed?

A training device that can be readily available in your back yard.

A training device should recruit more tennis player by boosting their confidence and facilitate their ability to play the game in short period of time.

The training device should train both the physical strength and the stroking power of the players by mimicking the exact movement of tennis playing. In other words, it is an advantage if one could practice a stroking movement and stroking speed at the same time as strengthening ones physique.

The device should be the same weight and longitudinal length as the standard tennis racquet so that the players don't feel any weight lifting exercise.

The device should use the air as a virtual ball and should have maximum aerodynamic drag.

The device should represent the modern way of playing style that is swinging the racquet to generate spin on the tennis ball it is therefore, the training device shouldn't perform unwanted movement rather than the intended trajectory.

The device should develop ones natural ability of playing and style and techniques.

Therefore there remains a need in the field of exercise equipment, particularly exercise racquets and the like which provides a mechanism or system to train that will substantially lower the amount of training hours and the consecutive number of training years one would need to achieve the professional level referred to above which is defined by certain said strengths, power, endurance and control a user would be expected to have of a racquet to play elite tennis or any other racquet sport.

This device, racquet, mechanism or system would also hopefully at the same time increase the level of confidence of the user which should have a compounding effect in that accelerated level of strength, endurance and control is being achieved with less training, giving the user time to enjoy other recreational and social activities.

There will also be the requirement to provide this exercise member so that it could be usable regardless of weather conditions and regardless as to whether or not the user had access to other paraphernalia such as racquets, balls, tennis courts and the like.

The object of this invention is to provide an exercise racquet that alleviates the above problems, or at least provides the public with a useful alternative.

SUMMARY OF THE INVENTION

Therefore in one form of the invention there is proposed an exercise racquet comprising:

a handle;

a planar member extending from the handle;

the planar member having a centrally located member;

the member including a longitudinally concave length located on one surface of the planar member;

the longitudinal concave length having curved wings with shoulders extending downwardly towards the planar member.

In preference the exercise racquet further includes apertures disposed in the planar member and located within the footprint of the curved wings.

In preference the exercise racquet further includes centrally located members extending from both sides of the planar member.

In preference the centrally located members are symmetrical.

In preference the planar member has a rim around its periphery.

In preference the exercise racquet further incorporates an electronic monitor to count the number of times the racquet is stroked through the air.

In preference data from said electronic monitor is wirelessly communicated to a remote monitoring device.

In a further form of the invention there is provided an exercise racquet adapted to accelerate a level of strength, endurance and control of a user's body, namely for tennis but can equally be used with sports such as cricket, golf and so forth, said racquet including:

a handle for a user to grasp;

a substantially flat planar member at an opposite end to the handle;

said planar member having a centrally located stabiliser unit;

said stabiliser unit including a pair of longitudinally concave lengths, one located each side of the respective upper and lower surfaces of said planar member;

said longitudinal concave lengths in parallel alignment with each other, separated at a distance by a central column to the concave lengths;

said longitudinal concave lengths having curved inner profiles that terminate at respective curved profile ends with extending shoulders;

said planar member further characterised in having apertures adjacent to either side of the central column;

such that as the planar member is stroked through the air resistance is placed against the planar member between racquet and user translated into exerted pressure upon arms, wrists, elbows, shoulders, knees, back and abdomen wherein a stabiliser unit is able to control the movement of the racquet as it is swung through the air by having the air that hits the longitudinal concave lengths diverted to opposing sides of the planar member such that the edge of the concave longitudinal length feeds the air equally on both sides of the surface resistively engaged with the air wherein the inner profile of the longitudinal concave lengths and the extending shoulder sees a mushroom type effect that allows air to engulf inwardly creating eddies and exit through the respective apertures to the other side of the stabiliser unit where such passing air hits the opposing curved profile of the other longitudinal concave length with force.

BRIEF DESCRIPTION OF THE DRAWINGS

The accompanying drawings, which are incorporated in and constitute a part of this specification, illustrate various implementations of the invention and, together with the description, serve to explain the advantages and principles of the invention. In the drawings.

LIST OF COMPONENTS

Figure 1:
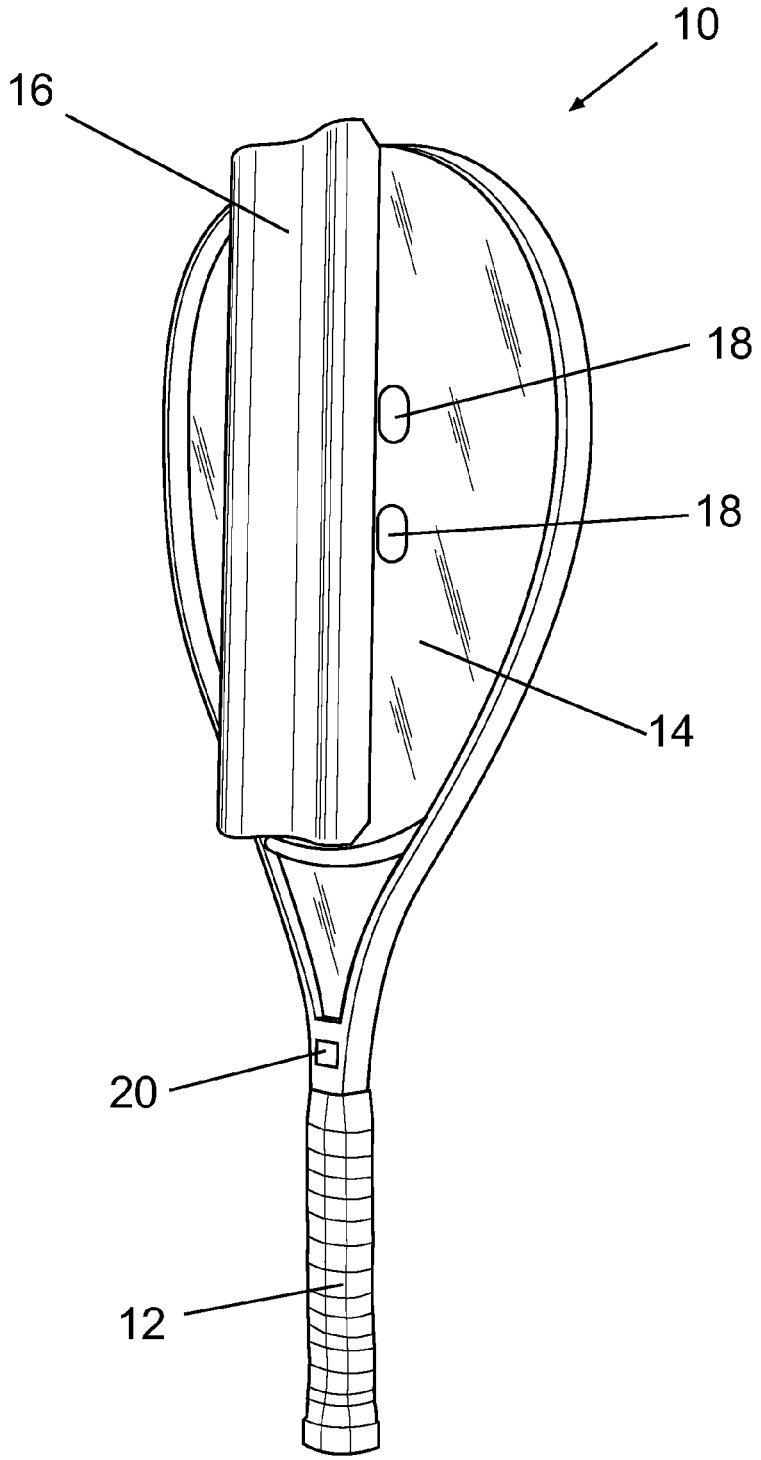
FIG. 1 is a perspective view of an exercise racquet according to a preferred embodiment of the invention.

10 exercise racquet
12 handle
14 planar member
16 stabiliser
18 apertures
20 electronic monitor
22 longitudinal concave lengths
24 central column
26 shoulders
28 inner profile curve length
30 rim
32 incoming air
34 channel air
36 channel air
38 eddies
40 eddies
42 user
44 wireless communication
46 display
48 display data

DETAILED DESCRIPTION OF PREFERRED EMBODIMENT

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts. Dimensions of certain parts shown in the drawings may have been modified and/or exaggerated for the purposes of clarity or illustration.

Referring to the drawings now in greater detail where there is provided an exercise racquet shown generally as 10.

As seen in FIG. 1 the main features of the exercise racquet 10 are a handle 12, a planar member 14 and a stabilizer 16. The handle is a typical handle as found on tennis racquets including features to improve one's grip. The exercise racquet is a symmetrical structure, operating identically for forward and backward strokes. However it is to be understood that the stabiliser may indeed be on one face of the planar member 14 only in which case the racquet could operate differently for forward or backward strokes.

Figure 2A:
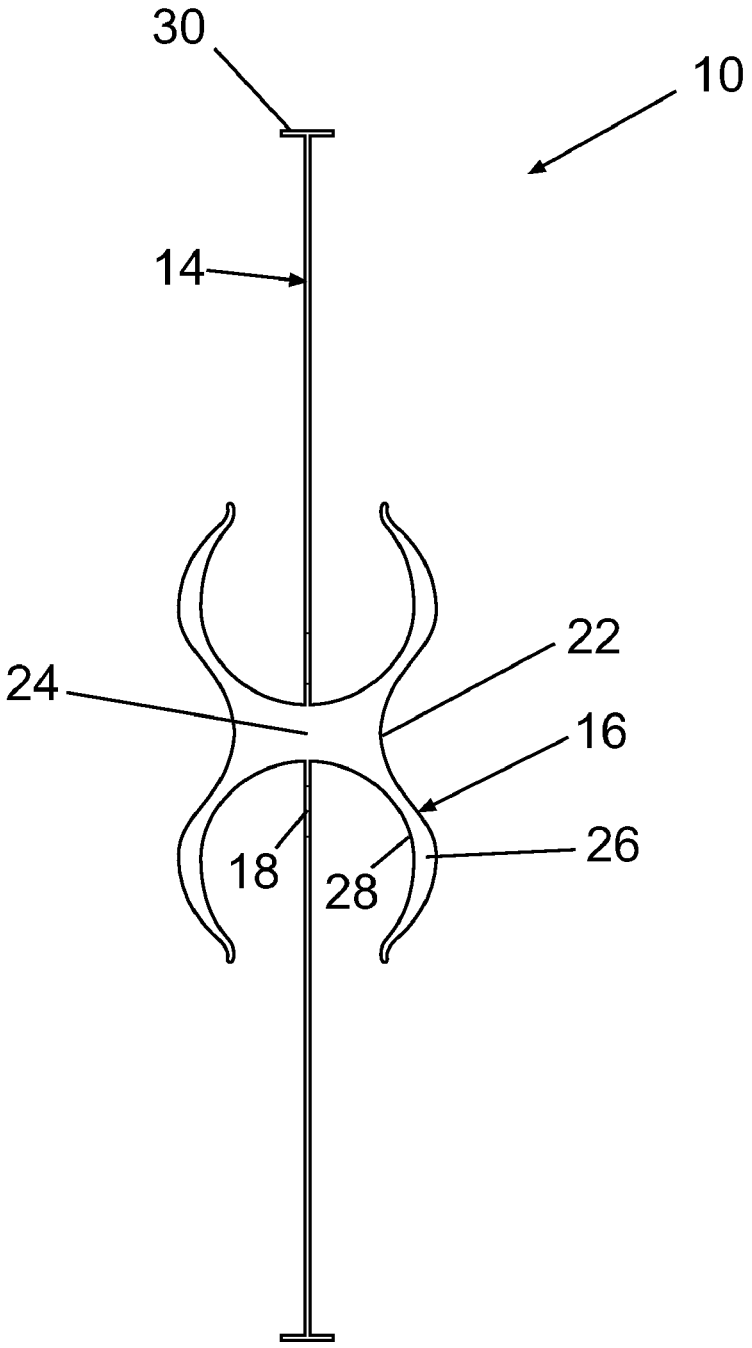
FIG. 2*a* is a top cross sectional view identifying the features associated with the air flow about the racquet.
Figure 2B:
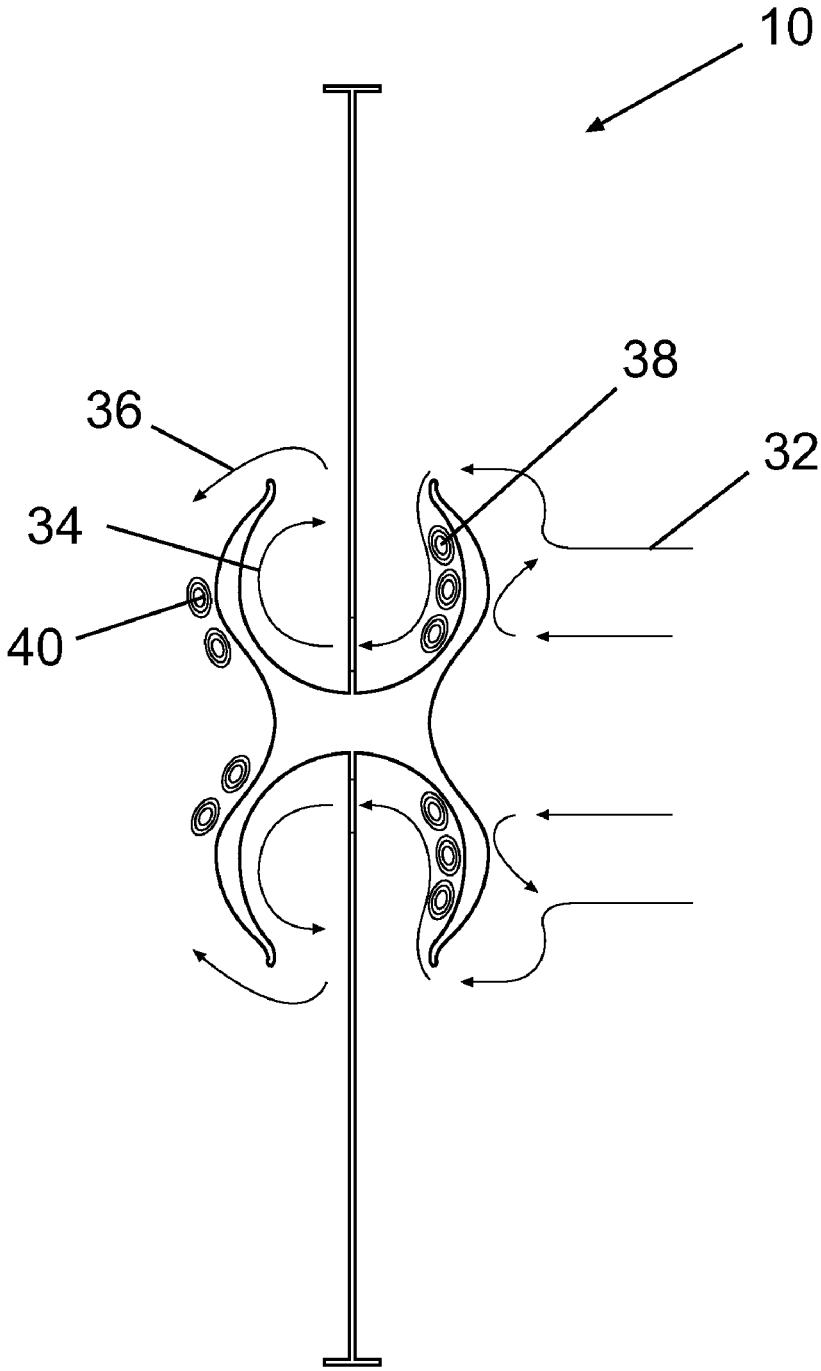
FIG. 2*b* is a top cross sectional view illustrating the air flow about the racquet in use with a perpendicular stroke.
Figure 2C:
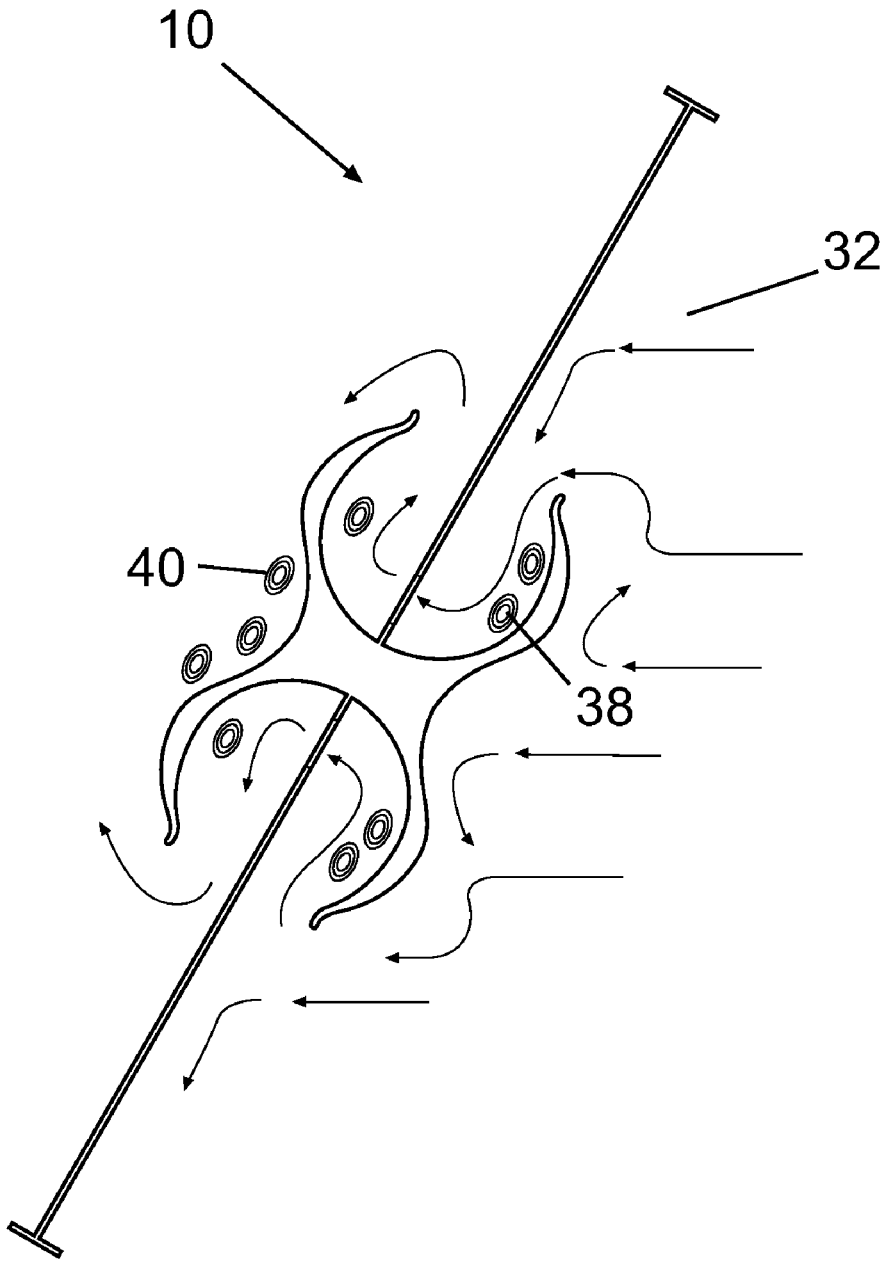
FIG. 2*c* is a top cross sectional view illustrating the air flow about the racquet in use with a non-perpendicular stroke.

As illustrated in FIG. 2(*a*), the stabiliser 16 includes a central column or web 24 extending through the planar member and supporting longitudinal concave lengths 22, shoulders 26 and inner profile curve lengths 28. The web 24 may not need to extend through the planar member 14 and each of the stabilisers may indeed be fixed to the face.

The longitudinal concave lengths 22 are nominally the same length as the planar member 14, but shorter lengths will also prove effective.

Apertures 18 are located in the planar member 14 adjacent to the central column 24 of the stabiliser 16. The apertures are located under the inner profile curve length 28 of the stabiliser. The exact position is not critical nor is their size.

The racquet produces drag as it is struck through the air as a result of air flow in all directions over the planar member 14 and the longitudinal concave lengths 22.

The racquet includes a rim 30 around the periphery of the planar member 14. Whilst not an essential feature, the rim aids in the stability and increases the drag of the racquet as it is struck through the air.

The racquet may include an electronic monitor 20 to monitor the number of strokes one makes during practice. The electronic monitor may also monitor the progressing strength and power improvements of the user by means suitably known to those in the art.

The combination of the apertures 18 along with the curvature of the stabiliser 16 allows the air to be diverted from the longitudinal concave lengths 22 to be spread evenly out across the planar member 14 and the remaining air to pass its way through the apertures to hit the back side of the corresponding inner profile curve length 28.

As introduced above the ability to redirect the flow of the air about the stabiliser 16 means that when the racquet 10 is in its stroke motion it will not be picked up with complete air resistance but rather the user 42 will be able to continue on with proper stroke action wherein such stroke action however has stressed upon it exerted pressure from the air as it disperses about the planar member 14 of the racquet as well as its engagement with the apertures 18 and the inner sides of the stabiliser.

The incoming air 32 is diverted out over the longitudinal concave lengths 22 and shoulders 26 of the stabiliser 16 to the planar member 14 or through the apertures 18 wherein eddies 38 and 40 are created that push back against the racquet 10 thereby establishing a stabilising drag, which is further assisted by the uplift of channel air 34 and 36.

Whilst the above provides resistance when the racquet is swung in generally perpendicular to the planar member axis, a further important function of the present invention is when the racquet is swung with the planar members not at right angles to the swing trajectory. In fact most tennis players these days swing the racquet at an angle to the swing trajectory to impart spin on the ball whether it is a forward or a back hand stroke. If there was only the planar member the racquet would be forced upwards by the air—known as the kiting effect. To overcome this and as is illustrated in FIG. 2(*c*), the stabiliser 16 disturbs the air flow. The air that would normally flow across the planar member is interrupted by the central column and is diverted through the apertures. This produces a force on the central column counteracting the kiting effect. The air incident on the longitudinal concave lengths is also diverted and finds its way through the apertures. These disturbed air flows also produce eddies adjacent to the inner profile curve lengths and the longitudinal concave profile lengths. These eddies help counter the kiting effect and stabilize the racquet trajectory. Thus in FIG. 2(*c*) the effect of the airflow around the racquet is that there is no net force on the racquet to divert it from its intended trajectory. The kiting effect is eliminated. Thus the present invention "acts" like a normal racquet with strings that obviously does not experience any kiting effect.

Figure 3:
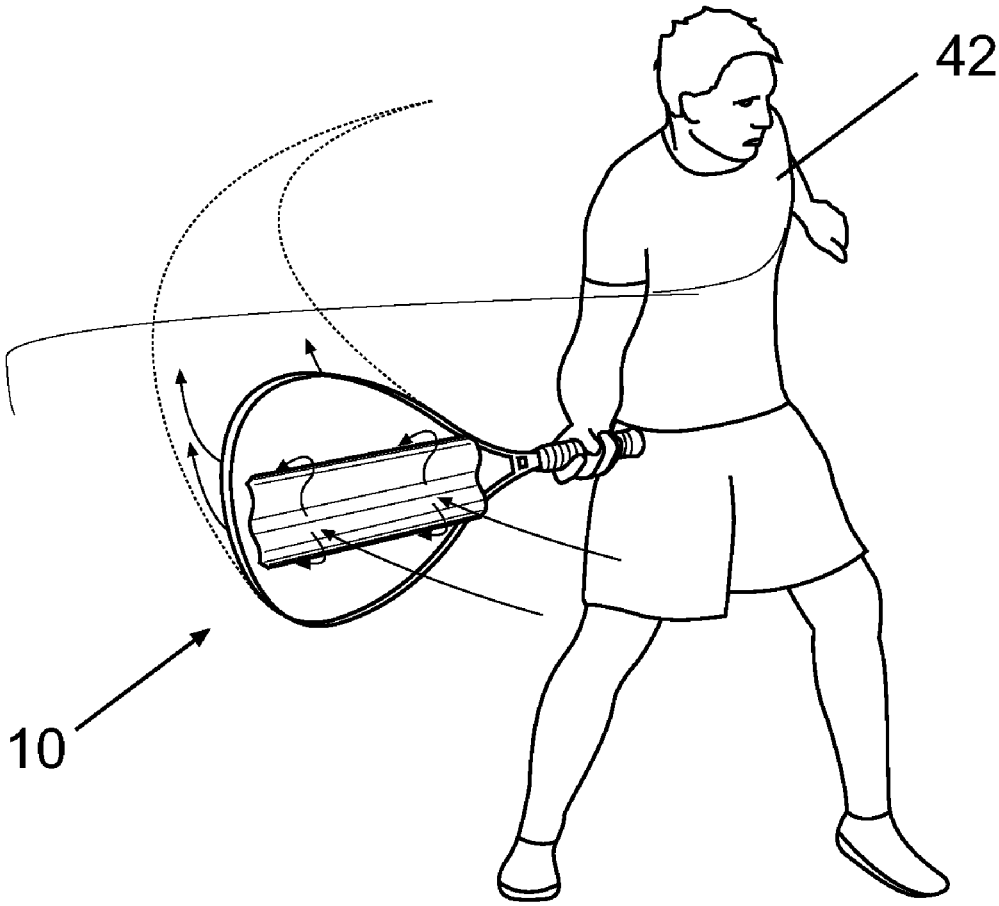
FIG. 3 is a perspective view showing a user during a stroke movement.

FIG. 3 simply shows the use of the racquet 10 in action by a user 42 wherein stroke movement by the user leads to an exerted pressure on the arms, wrists, elbows, shoulders, knees, back and abdomen of the user.

Figure 4:
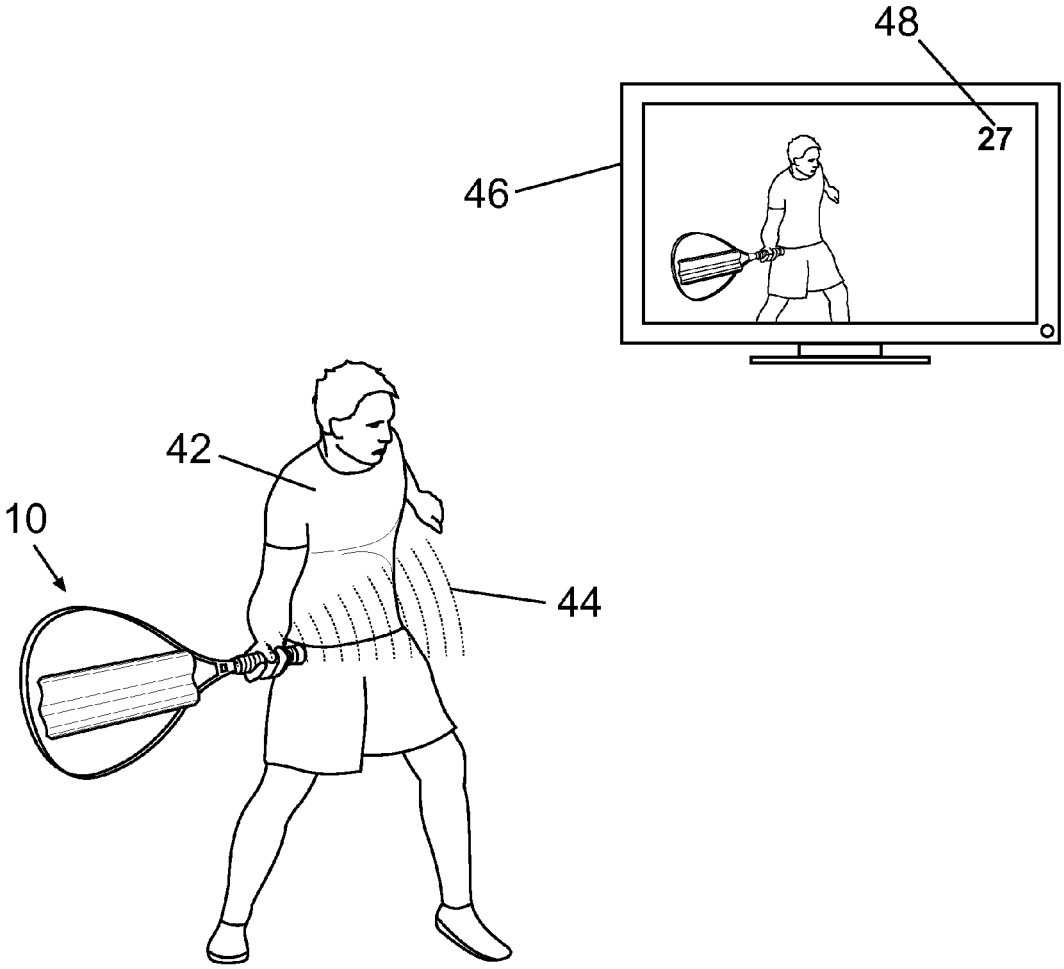
FIG. 4 illustrates an embodiment of this invention including electronic interaction and information devices.

FIG. 4 shows a further embodiment of the invention where an electronic monitor 20 and wireless communication 44 is introduced into the racquet 10 so that the user 42 through wireless communication is able to view various display data 48 upon a display 46 that can include images of the player thereof or alternatively and/or statistical and the like information such as the number of strokes which can be viewed in real time or stored for review subsequently.

As the person skilled in the art will appreciate the racquet can be a variety of weight and sizes depending on the age group intended for use of the racquet including the same weight and size as a standard racquet. Whilst maintaining the same size as a standard racquet is aesthetically desirable, by using other sizes different levels of drag can be produced.

The reader should now appreciate the advantages of the present invention. As air flows across the front stabiliser or wing (depending on what the stroke is) it passes through the apertures where it makes contact with the inner curved profile of the adjacent longitudinal concave length means. As a result the movement is decelerated equally on the top and the bottom side of the stabiliser by maintaining stable direction of movement. The air then engulfs outwardly around the mushroom shape and exits the stabiliser, which gives smoothness and total control to the movement.

An advantage of such an arrangement is that for the first time a user is able to legitimately experience the controlled movement of a racquet stroke, whether it be forehand or backhand, at the same time have an exerted force and pressure placed against the user's arms, wrists, elbows, shoulders, knees, back and abdomen by the fact that the wind abutting member is actually frictionally or resistively high aerodynamic drag engaged as the user strokes their way through the movement. The aerodynamic drag varies depending on the stroke velocity with the greater the speed the greater the drag.

For example if there was no stabiliser for redirecting the movement of air as it contacts the substantially flat planar member, all that would simply take place is that a user would be almost scooping up air, or pushing the racquet almost like a kite through the stroke movement.

While this may provide some exerted pressure upon the user's upper body, all control, repetitiveness and stability is lost, because power is not being used to strengthen the user's technique but to simply maintain stability of the floating device. The slice through the air would force the device away from the intended trajectory which may cause injury or accident.

The unique use of the stabiliser is that the air which is coming in contact with the substantially flat planar member of the racquet is uniquely spread out and redirected so that correct stroke movement can be maintained. Moreover not only is correct stroke movement maintained but there is a greater exerted pressure placed against the user's stroke movement, albeit with controlled stability, that there can be an accelerated increase in the user's strength, endurance and control of the racquet.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

For example, although the above description described the stabilisers at either surface of the planar member being the same, they could in fact be of different size and shape to facilitate different aerodynamic flows. It is thus not the intention of this specification to limit it to the same shape and size of stabiliser or wing on either surface.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. An exercise racquet comprising:

a handle;

a planar member extending from the handle;

the planar member having a centrally located member;

the member including a longitudinally concave length located on one surface of the planar member;

the longitudinal concave length having curved wings with downwardly extending shoulders.

2. An exercise racquet as in claim 1 further including apertures disposed in the planar member and located within the footprint of the curved wings.

3. An exercise racquet as in claim 1 further including centrally located members extending from both sides of the planar member.

4. An exercise racquet as in claim 3 wherein the centrally located members are symmetrical.

5. An exercise racquet as in claim 1 wherein the planar member has a rim around its periphery.

6. An exercise racquet as in claim 1 further incorporating an electronic monitor to count the number of times the racquet is stroked through the air.

7. An exercise racquet as in claim 6 wherein data from said electronic monitor is wirelessly communicated to a remote monitoring device.

* * * * *